US005277019A

United States Patent [19]

Karhu

[11] Patent Number: 5,277,019

[45] Date of Patent: Jan. 11, 1994

[54] REVERSE STRANDING APPARATUS

[75] Inventor: Raimo Karhu, Helsinki, Finland

[73] Assignee: Nokia-Maillefer Holding S.A., Ecublens, Switzerland

[21] Appl. No.: 929,909

[22] Filed: Aug. 17, 1992

[30] Foreign Application Priority Data

Aug. 28, 1991 [FI] Finland ..... 914067

[51] Int. Cl.[5] ..... H01B 13/04

[52] U.S. Cl. ..... 57/293

[58] Field of Search ..... 57/293, 294, 204, 205, 57/1 Un

[56] References Cited

U.S. PATENT DOCUMENTS

| | | | |
|---|---|---|---|
| 3,847,190 | 11/1974 | Forester | 57/293 X |
| 4,151,704 | 5/1979 | Spicer et al. | 57/13 |
| 4,426,838 | 1/1984 | Garner et al. | 57/293 |
| 4,426,839 | 1/1984 | Garner et al. | 57/293 |
| 4,590,755 | 5/1986 | Garner | 57/293 |
| 4,974,408 | 12/1990 | Karhu | 57/293 |

FOREIGN PATENT DOCUMENTS 1305559 2/1973 United Kingdom .

*Primary Examiner*—Joseph J. Hail, III

*Attorney, Agent, or Firm*—Nixon & Vanderhye

[57] ABSTRACT

A reverse stranding apparatus for the reverse stranding of conductors. The apparatus comprises a stationary divider element, a twisting element rotatable in different directions, and a central element disposed between said parts, and peripheral tubes surrounding said central element, the central element and the peripheral tubes being pressed against each other at least during the twisting step of the conductors and the conductors to be stranded being adapted to pass through at least the peripheral tubes. To attain high speeds of rotation, the peripheral tubes and the central element are united in a tube packet by a reticular fabric enveloping the peripheral tubes and extending substantially over the entire length of said peripheral tubes.

4 Claims, 1 Drawing Sheet

FIG. 1
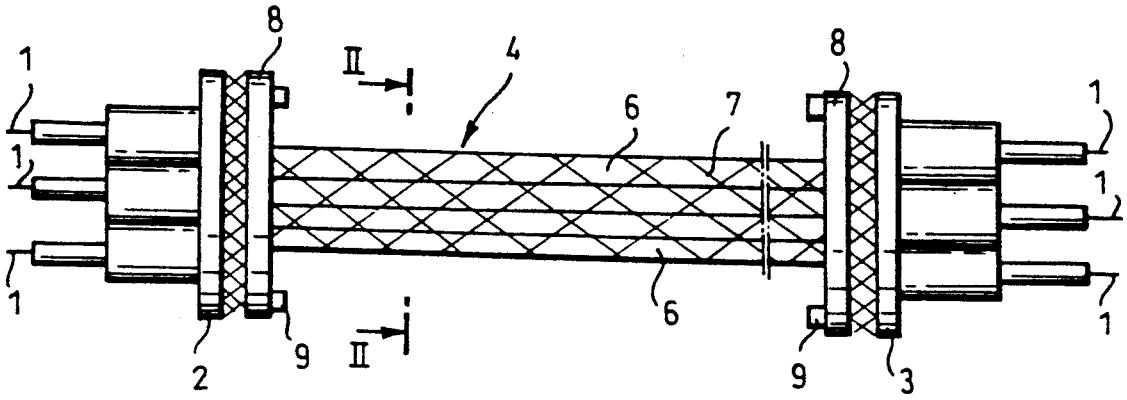
FIG. 2
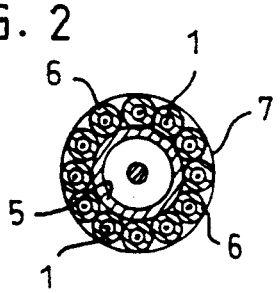
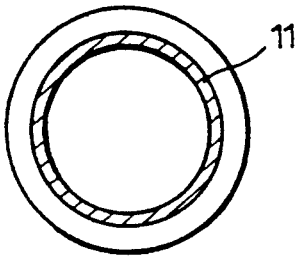
FIG. 3
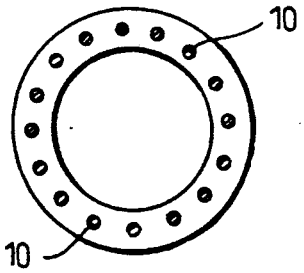
FIG. 4
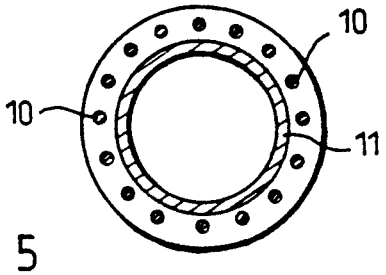
FIG. 5

REVERSE STRANDING APPARATUS

A reverse stranding apparatus for the reverse stranding of conductors, such as filaments, conductor elements, bundles of conductors, optical fibres and similar for the manufacturing of cables or the like, comprising a stationary divider means disposed at the upstream end for the conductors to be stranded, a twisting means rotatable in different directions and disposed at the downstream end for the conductors to be stranded, and a medially disposed central element rotatable recurrently about its longitudinal axis in opposite directions and peripheral tubes being twistable recurrently in opposite directions and peripherally surrounding the central element, the central element and the peripheral tubes being disposed between the divider means and the twisting means and being pressed against each other at least during the twisting step of the conductors and the conductors to be stranded being adapted to pass through at least the peripheral tubes.

A wide variety of apparatus as presented above are known for instance in the cable industry. The apparatus disclosed in U.S. Pat. No. 4,974,408 may be mentioned as an example of prior art apparatus in this field. The apparatus disclosed in said U.S. Patent operates completely faultlessly in most circumstances. However, in some circumstances the operation is not the best possible. For example, it has been found in practice that with high speeds of rotation of a tube packet, centrifugal force will produce outward radial displacement of the peripheral tubes on the unbound portions thereof. In the above known solution, the peripheral tubes are bound by means of spaced elastic rings, the compression force of which acts only on a specific longitudinal area of the tubes. The axial spanning force on the tube packet and the relative distance of the elastic rings together define the maximum speed of rotation. Exceeding said speed will have the result that the outer peripheral tubes bulging outwards under the influence of centrifugal force displace the elastic rings in the axial direction, and thus with this mechanism the disruption will be self-augmenting. Also the central tube has a tendency to come out from between the peripheral tubes, if it has been stretched more than the outer peripheral tubes. Another problem is presented by creep, which is due to the properties of the plastics used as the tube material. The creep is very intense at the initial stage of putting into use the tube packet, and consequent thereon the tube packet must be shortened several times. Later said creep will diminish, but it will never cease. On account of the creep, the maximum length of the tube packet is limited, which again limits the maximum relative distance of the reversing points. A third problem worth mentioning is that the desired axial spanning force cannot be used owing to the material employed. This fact is reflected in sagging of the tube packet, which in turn will produce undesired whirling. It is known from experience that a large sag of the tube packet will increase the friction coefficient between the tube and the conductor. The plastics that are most suitable for use as tube materials typically have high friction coefficients and poor mechanical strength values. In the prior solutions, specifically the friction coefficient between the tube and the conductor is the most significant factor affecting the number of upturns in the same direction which is obtained. The intent is to achieve a maximum number of upturns in the same direction, as by this means the reversing points can be disposed far from one another, and this again improves the electrical characteristics of a telecommunications cable.

It is the object of the present invention to provide a reverse stranding apparatus wherewith the drawbacks of the prior art can be eliminated. This has be achieved with the reverse stranding apparatus of the invention, which is characterized in that the peripheral tubes and the central element are united in a tube packet by means of a reticular fabric enveloping the peripheral tubes and extending substantially over the entire length of said peripheral tubes.

The advantage of the invention lies above all in that by means of the binding achieved with a reticular fabric enveloping the peripheral tubes, i.e. a sleeve-like fabric, the tube packet can find its neutral axis freely, which allows remarkably high speeds of rotation for the tube packet. Very high grouping and stranding speeds are possible even with small upturn values. Generally speaking, it can be said that due to the invention, a situation is achieved where the tube packet will no longer limit the speed of rotation, but the limiting factor is constituted by the motor. In the arrangement in accordance with the invention, the tube packet lies within the reticular sleeve for its entire length, and thus the construction is safer and more durable that the prior solutions. Further, it is to be noted that at no time will the central element be able to push out from between the peripheral tubes. In the construction according to the invention, the tube packet will retain its initial longitudinal dimension for its entire service life. The axial spanning force on the tube packet can be increased manyfold, thus permitting effective prevention of whirling. A smaller friction than heretofore is achieved between the tube and the conductor, since it is known from experience that the smaller the sag, the lower the friction. Thus, the length of the tube packet will not constitute a restricting factor. A further advantage is that by means of the invention, different and continuously varying run profiles of speed of rotation for the rotating head can be employed without any restrictions. The rotating head and the tube packet typically display very high speeds of rotation, continuously changing direction. A small friction between the tube and the conductor will add to the windings of the tube packet in the same direction. A better quality than heretofore is achieved for sophisticated cables. The grouping or stranding procedures do not induce any forces acting adversely on the conductor or any deformation that would stretch the conductor, for instance.

The invention will be explained in more detail in the following by means of preferred embodiments described in the accompanying drawing, wherein FIG. 1 is a schematic elevational view of a tube packet in a reverse stranding apparatus of the invention, FIG. 2 is a sectional view taken along arrows II—II in FIG. 1, and FIGS. 3 to 5 show different peripheral tube or central element variations in the tube packet of FIGS. 1 and 2 in axial view.

FIG. 1 is a schematic representation of a tube packet in a reverse stranding apparatus of the invention. In FIG. 1, the reference numeral 1 denotes the conductors to be stranded, and the reference numeral 2 denotes a stationary divider means disposed at the upstream end for the conductors 1. The reference numeral 3 in FIG. 1 denotes a twisting means disposed at the downstream end for the conductors to be stranded, rotatable in different directions. The reference numeral 4 generally denotes a tube packet. The tube packet 4 comprises a central element 5 and discrete peripheral tubes 6 peripherically surrounding it. The central element 5 and the peripheral tubes 6 are pressed against each other at least during the twisting step of the conductors.

The term conductor in this context refers to filaments, conductor elements, bundles of conductors, quads, optical fibres and other similar elements. The stationary divider means 2 and the rotatable twisting means 3 may be apertured disks, for instance.

In accordance with an essential feature of the invention, the peripheral tubes 6 and the central element 5 are united in a tube packet 4 by means of a reticular fabric 7 enveloping the peripheral tubes and extending substantially over the entire length of said peripheral tubes 6. The reticular fabric 7 enveloping the peripheral tubes 6 in a sleeve-like manner can be fixed at its one end to the stationary divider means 2 and at its other end to the rotatable twisting means 3. The fixing may be effected for example by means of squeeze heads 8 and screws 9, in which situation the reticular fabric is squeezed between the stationary divider plate 2 and a squeeze head 8, for instance.

The reticular fabric 7 rotates with the peripheral tubes 6 and allows twisting and relative movement of the tubes, but prevents their radial movement outwards. As the peripheral tubes are twisted, the length of the tube packet 4 diminishes and the outer diameter increases. The reticular sleeve-like fabric 7 behaves in a similar way, because when the fabric is shortened the outer diameter increases accordingly. The reticular fabric 7 squeezes the peripheral tubes 6 in all circumstances radially against the central element 5, and the squeezing force can additionally be regulated. By suitably selecting the manufacturing material of the reticular fabric 7, the axial spanning force on the tube packet can be raised considerably higher than in connection with the previously known arrangements. Various plastics or metals are examples of suitable manufacturing materials for the reticular fabric. Upon squeezing the peripheral tubes 6, the reticular fabric 7 takes up part of the axial force referred to above. The torque required to twist the tube packet 4 will not be excessively high even with large-sized tube packets, since the reticular fabric permits the twisting of the tubes about their central axes. The number of peripheral tubes 6 in the tube packet 4 may vary freely according to current need. The central element 5 may be an enclosed construction, i.e. a tube or a hollow element. The central element, advantageously its hub, may incorporate a suitable central member, such as a bar, a wire cable or similar.

Filaments or fibres may be fitted to the central element and/or the walls of the peripheral tubes during the manufacture. FIGS. 2 to 5 show examples of alternative peripheral/central tube constructions. The filaments or fibres are indicated by the reference numeral 10 in FIGS. 4 and 5. The filaments or fibres 10 may be straight, i.e. axial, wound in opposite upturn directions, or have a reticular pattern. The purpose of the filaments or fibres 10 is to take up axial loads and to prevent creep of the tube packet 4. The filaments or fibres also have an effect on the whirling referred to previously, since the greater the force with which the tube packet can be spanned in the axial direction, the more effectively whirling is prevented. The discrete filaments or fibres may be for instance carbon, aramide, boron or steel fibres. The central element and the peripheral tubes may employ the same fibres or filaments. The central element may further incorporate a bar, a wire cable, etc. as set forth previously.

Another possibility is to use fibre-reinforced plastic material in the manufacture of the tube packet 4.

The tubes 6 in the packet 4 may also be manufactured from two different materials, that is, the outer surface from a material having a good mechanical strength and the inner surface from a material having a very low friction. This permits the friction between the conductors and the inner surfaces of the peripheral tubes to be minimized, thus producing cables of a higher quality. Peripheral tubes 6 constructed from two different materials are shown in FIGS. 3 and 5. In these figures, the low-friction material is indicated by the reference numeral 11. The low-friction material 11 may be PTFE, for instance, which as such does not provide a suitable material for the tube packet on account of its poor mechanical properties. The other material may be for instance PA plastic. It is naturally also possible to use more than two different materials for the manufacture of the tube packet, for instance it is possible to use three different materials, and so on.

When a reverse-stranded product is manufactured with an apparatus having a tube packet in accordance with FIG. 1, the conductors 1 to be stranded are drawn through the divider means 2 into the peripheral tubes and further through the rotatable twisting means 3 out for instance into a nozzle disposed downstream of the twisting means in the running direction of the conductors, the nozzle having a tapering opening wherein the stranded conductors are pressed tightly against one another, thus forming a reverse-stranded product. The nozzle is not an indispensable detail. The completed product may, if desired, additionally be bound to prevent untwisting. Any conventional spinning device or other similar apparatus may be used for the binding. The twisting means 3 is fitted with a rotatable drive of its own, preferably with a chain gear, gear transmission, or cogged belt driven electric motor whose speed of rotation can be regulated and reversing automation realized fairly simply. The general features as presented above relating to the operation and use of the reverse stranding apparatus, i.e. the drawing of the conductors, rotating of the tube packet, further processing of the product etc., are conventional to one skilled in the art, wherefore these features are not more closely described in this connection. In addition to the above features, U.S. Pat. No. 4,974,408 referred to previously in the context of such matters is incorporated herein by reference.

The embodiments set forth above are in no way intended to restrict the invention, but the invention may be modified fully freely within the scope of the claims. Thus it is to be understood that the apparatus of the invention or its details need not necessarily be exactly as shown in the figures, but the other solutions are possible as well. For instance, the number of peripheral tubes has by no means been limited to the embodiments shown in the figures, but such details may be modified freely in accordance with the current need.

I claim:

1. A reverse stranding apparatus for the reverse stranding of conductors, conductor elements, bundles of conductors, optical fibres and similar materials for the manufacturing of cables comprising a stationary divider means disposed at the upstream end for the conductors to be stranded, a twisting means rotatable in different directions and disposed at the downstream end for the conductors to be stranded, and a medially disposed central element rotatable recurrently about its longitudinal axis in opposite directions and peripheral tubes being twistable recurrently in opposite directions and peripherally surrounding the central element, the central element and the peripheral tubes being disposed between the divider means and the twisting means and being pressed against each other at least during the twisting step of the conductors, the conductors to be stranded being adapted to pass through at least the peripheral tubes, and the peripheral tubes and the central element being united in a tube packet by means of a reticular fabric enveloping the peripheral tubes and extending substantially over the entire length of said peripheral tubes.

2. A reverse stranding apparatus as claimed in claim 1, wherein the reticular fabric is fixed at its one end to the stationary divider means and at its other end to the rotatable twisting means.

3. A reverse stranding apparatus as claimed in claim 1, wherein filaments or fibres are fitted in the central element and/or the walls of the peripheral tubes during the manufacture.

4. A reverse stranding apparatus as claimed in claim 1 wherein the peripheral tubes and/or the central element are manufactured from at least two different materials in such a way that the outer surface is from a material having a good mechanical strength and the inner surface from an elastic material having a very low friction.

* * * * *